US012644470B2

(12) United States Patent
Tuomisalo

(10) Patent No.: US 12,644,470 B2
(45) Date of Patent: Jun. 2, 2026

(54) SUCTION LINER AND CENTRIFUGAL PUMP COMPRISING THE SAME

(71) Applicant: Metso Sweden AB, Malmö (SE)

(72) Inventor: Aki Tuomisalo, Espoo (FI)

(73) Assignee: Metso Sweden AB, Malmö (SE)

( * ) Notice: Subject to any disclaimer, the term of this patent is extended or adjusted under 35 U.S.C. 154(b) by 0 days.

(21) Appl. No.: 18/262,668

(22) PCT Filed: Jan. 27, 2022

(86) PCT No.: PCT/EP2022/051879
§ 371 (c)(1),
(2) Date: Jul. 24, 2023

(87) PCT Pub. No.: WO2022/162057
PCT Pub. Date: Aug. 4, 2022

(65) Prior Publication Data

US 2024/0392802 A1 Nov. 28, 2024

(30) Foreign Application Priority Data

Jan. 27, 2021 (SE) ..... 2150088-9

(51) Int. Cl.
*F04D 29/42* (2006.01)
*F04D 29/08* (2006.01)

(52) U.S. Cl.
CPC ..... *F04D 29/4286* (2013.01); *F04D 29/086* (2013.01)

(58) Field of Classification Search
CPC ..... F04D 29/086; F04D 29/4286
See application file for complete search history.

(56) References Cited

U.S. PATENT DOCUMENTS 1,671,054 A * 5/1928 Welsh ..... F04D 29/4286 415/206
3,551,067 A 12/1970 Wissman
(Continued)

FOREIGN PATENT DOCUMENTS

CN 86100758 A * 8/1987
CN 102213219 A 10/2011
(Continued)

OTHER PUBLICATIONS

Machine translation of JP 2017203438, Kuronuma, published Nov. 16, 2017 (Year: 2017).*
(Continued)

*Primary Examiner* — Nathaniel E Wiehe
*Assistant Examiner* — Jason G Davis
(74) *Attorney, Agent, or Firm* — Andrus Intellectual Property Law, LLP

(57) ABSTRACT

A suction liner for a centrifugal pump for processing slurries. The suction liner includes a cylindrical portion arrangeable in the casing of the centrifugal pump, and a flange portion which protrudes outwards in a radial direction from the cylindrical portion. The flange portion is arrangeable such that, when mounted in a centrifugal pump, at least a portion of a front end surface of the flange portion of the suction liner abuts against at least a portion of a front end of the impeller to seal an axial gap between the suction liner and the impeller, and at least the front end surface of the flange portion is made of a low friction polymer. A centrifugal pump for processing slurries can be used with the suction liner. The suction liner and the centrifugal pump allow preventing recirculation of pumping liquid in a centrifugal pump and, thereby, reducing wear.

11 Claims, 3 Drawing Sheets

(56) References Cited

U.S. PATENT DOCUMENTS

| | | | | |
|---|---|---|---|---|
| 4,535,326 | A * | 8/1985 | Mullins | F04B 53/00 417/63 |
| 4,722,664 | A | 2/1988 | Wissman | |
| 5,513,954 | A * | 5/1996 | Bourgeois | F04D 29/4286 415/196 |
| 5,941,536 | A | 8/1999 | Hill | |
| 7,470,106 | B1 | 12/2008 | Blattmann | |
| 7,871,241 | B2 * | 1/2011 | Bourgeois | F04D 27/00 415/128 |
| 9,739,285 | B2 * | 8/2017 | Kosmicki | F04D 29/628 |
| 2014/0072424 | A1 | 3/2014 | Korupp et al. | |

FOREIGN PATENT DOCUMENTS

| | | | | |
|---|---|---|---|---|
| CN | 104533798 | A | | 4/2015 |
| CN | 217518919 | U | | 9/2022 |
| JP | 2017203438 | A | * | 11/2017 |
| WO | 2014144253 | A1 | | 9/2014 |

OTHER PUBLICATIONS

CN-86100758-A (machine translation) (Year: 1987).*

Office Action for Swedish Patent Application No. 2150088-9, dated Oct. 19, 2022.

International Search Report and Written Opinion for PCT/EP2022/051879, mailed May 6, 2022.

International Preliminary Report on Patentability for PCT/EP2022/051879, mailed Apr. 6, 2023.

Office Action and Search Report for Chinese Patent Application No. 2022100998775, issued Dec. 4, 2024.

Office Action and Search Report for Chinese Patent Application No. 2022100998775, issued Apr. 24, 2025.

* cited by examiner

SUCTION LINER AND CENTRIFUGAL PUMP COMPRISING THE SAME

CROSS-REFERENCE TO RELATED APPLICATIONS

This application is the U.S. national stage application of International Application PCT/EP2022/051879, filed Jan. 27, 2022, which international application was published on Aug. 4, 2022, as International Publication WO 2022/162057 A1 in the English language. The International Application claims priority Swedish Patent Application No. 2150088-9 filed Jan. 27, 2021.

FIELD OF THE DISCLOSURE

The present disclosure relates to a liner and a centrifugal pump comprising such a liner. More specifically, the disclosure relates to a suction liner and a centrifugal pump comprising the suction liner, particularly suitable for processing slurries.

BACKGROUND ART

Centrifugal pumps are known in the art for pumping fluids and can be used for different applications, such as for processing slurries. Typically, centrifugal pumps for processing slurries comprise an impeller supported on a shaft which is rotated by an external motor. The impeller is housed within a casing having an inlet for fluid and an outlet for discharging the pumped fluid, commonly referred to as the discharge. In use, fluid from the inlet flows to the center of the impeller, whereby the rotation of the impeller forces the fluid towards the peripheral regions of the casing to be discharged through the outlet. The centrifugal forces resulting from the rotation of the impeller together with the dynamic action of the impeller vanes on the fluid produce pressure gradients within the pump, with a lower pressure being created closer to the center of the impeller, also referred to as the eye, and a higher pressure being created closer to the discharge and the outer diameter of the impeller. There is, thus, an increase of the pressure from the eye of the impeller and radially outwards thereof. This pressure change often causes recirculation of fluid through a gap present between the impeller and the casing of the pump, commonly referred to as the nose gap. Such recirculation is undesirable considering that it reduces the performance of the pump and, when processing liquids containing solid particles, increases wear of the impeller as well as of the casing. Such wear problems are particularly pronounced when processing abrasive slurries.

One type of centrifugal pumps for processing slurries comprises a liner to provide wear protection for the casing on the suction side of the impeller. Such liners are typically of a wear resistant material, e.g. a high chrome alloy. Another common liner material is natural rubber. To avoid recirculation through the nose gap, the axial distance between the liner and the impeller is adjusted such to keep the nose gap minimized without allowing the liner to touch the impeller. Such contact would cause premature wear of the liner due to e.g. heat cracking of the high chrome alloy or tear of the natural rubber.

Although this type of liner arrangements may reduce recirculation to some extent and, thus, wear of the impeller and the liner while increasing the efficiency of the pump, it is still susceptible to recirculation of fluid, presenting a drawback in terms of pumping performance and durability of the components of the pump. It would thus be advantageous to prevent recirculation completely or at least as much as possible.

Furthermore, the process commonly used for adjusting the liner of such centrifugal pumps, commonly used for processing slurries, to minimize the nose gap is carried out manually and requires an experienced operator to listen for a certain sound which confirms that the adequate position of the liner with respect to the impeller is reached. This is a laborious and time consuming labour.

SUMMARY

It is an object to mitigate, alleviate or eliminate one or more of the above-identified deficiencies in the art and disadvantages singly or in any combination and to solve at least the above mentioned problems.

According to a first aspect of the disclosure, there is provided a suction liner for a centrifugal pump for processing slurries, the centrifugal pump comprising an impeller housed in a casing, the suction liner comprising a cylindrical portion arrangeable in the casing of the centrifugal pump, and a flange portion which protrudes outwards in a radial direction from the cylindrical portion. The flange portion is arrangeable such that, when mounted in a centrifugal pump, at least a portion of a front end surface of the flange portion of the suction liner abuts against at least a portion of a front end of the impeller, such to seal an axial gap between the suction liner and the impeller, and at least the front end surface of the flange portion is made of a low friction polymer.

The suction liner is advantageous as it allows fully sealing a nose gap between the suction liner and the impeller, i.e. abutting the impeller, when the suction liner is mounted in a centrifugal pump, preventing recirculation of liquid therein. With no, or reduced, recirculation, wear of the suction liner and of the impeller front end is reduced resulting in increased durability and, thus, service life, of these components. This is particularly advantageous when processing abrasive or heavy slurries containing solid particles.

By providing a suction liner with a flange portion wherein at least the front end surface of the flange portions is made of a low friction polymer, the inventors surprisingly found that the suction liner can be arranged to abut against the impeller such to completely seal the axial gap between the liner and the impeller, typically called the nose gap, without the components suffering from excessive wear. The low friction polymer preferably has high mechanical strength to withstand the dynamic pressure exerted thereon by the rotating impeller during operation of the pump. Further, the low friction polymer allows the suction liner to abut against the impeller without deteriorating due to excessive heat generated in the contact area between the low friction polymer of the suction liner and the impeller during operation of the pump as the impeller rotates.

In an embodiment, the low friction polymer is a high performance thermoplastic. In an embodiment, the high performance thermoplastic is a semi-crystalline thermoplastic. Such materials provide particularly high resistance to temperature and to chemical substances, which is advantageous. Examples of high performance thermoplastics are poly(phenylene sulfide) (PPS), polyetheretherketone (PEEK) and polyether ketones (PEK). According to a preferred embodiment, the low friction polymer is PEEK. Other polymer materials providing a low friction coefficient and high mechanical properties can also be used in the suction liner within the concept of the present disclosure, such as for example ultra high molecular weight polyethylene (UHMWPE), polytetrafluoroethylene (PTFE), polyamide, phenolics and polyoxymethylene (POM).

According to an embodiment, the entire suction liner is made of the low friction polymer. This provides a liner which is easy and efficient to manufacture in one single piece.

According to an embodiment, the suction liner is made of a metal which is coated with the low friction polymer. The metal liner provides mechanical stability to the suction liner while the low friction polymer coating provides low friction against the impeller and thus reduces wear, which is advantageous.

According to an embodiment, at least a portion of the front end surface of the flange portion is arrangeable to be flush against at least a portion of the front end of the impeller, such to seal an axial gap between the flange portion and the impeller. This is advantageous in that it does not require any complex surface geometry of the suction liner which for example could cause potential stress concentrators. Providing a flush surface of the flange portion further facilitates the production of the suction liner.

According to an embodiment, the portion of the front end surface arrangeable to abut against a portion of the front end of the impeller is curved, the curved shape corresponding with an inversely curved shape of the front end of the impeller. Other shapes of the front end surface of the flange portion and the front end of the impeller, such as jigsaw, are also possible provided that a portion of the front end surface of the flange portion abuts against a portion of the front end of the impeller.

According to an embodiment, the front end surface portion of the flange portion, arrangeable to abut against at least a portion of the front end of the impeller when the suction liner is mounted in a centrifugal pump, extends along a circumference of the front end surface. This provides a circumferential seal of the nose gap, preventing recirculation of liquid processed by the pump.

According to a second aspect of the disclosure, there is provided a centrifugal pump for processing slurries, the centrifugal pump comprising an impeller, an impeller shaft, a casing which houses the impeller, which casing comprises an inlet and an outlet, and a suction liner as disclosed herein. The cylindrical portion of the suction liner is arranged along an inner wall of the casing and the flange portion of the suction liner is arranged to at least partially abut against a front end of the impeller.

The centrifugal pump is advantageous in that recirculation of the pumped liquid, i.e. slurry, is prevented by the suction liner being arranged in abutment with the impeller, also reducing wear of the pump components, as described previously with respect to the suction liner alone. Furthermore, providing the suction liner which is operable in abutment with the impeller facilitates mounting of the suction liner in the casing and against the impeller. Due to the liner being allowed to contact the impeller, adjustment of the position of the suction liner with respect to the impeller to reach the desired position is more easily controlled, which is advantageous.

According to an embodiment, the cylindrical portion of the suction liner is arranged along the inner wall of the casing inlet. This provides wear protection for the casing at the inlet of the centrifugal pump.

According to an embodiment, the centrifugal pump further comprises a drive liner, also commonly referred to as a back liner, having a front end surface arranged to abut against a back end surface of the impeller, wherein at least the front end surface of the back liner comprises a low friction polymer. This provides a seal of the axial gap between the casing and the impeller on the back side of the impeller, preventing abrasive particles from passing there through resulting in reduced wear of the impeller and the casing.

Effects and features of the second aspect is largely analogous to those described above in connection with the first aspect. Embodiments mentioned in relation to the first aspect are largely compatible with the second aspect. It is further noted that the inventive concepts relate to all possible combinations of features unless explicitly stated otherwise.

A further scope of applicability of the present disclosure will become apparent from the detailed description given below. However, it should be understood that the detailed description and specific examples, while indicating preferred embodiments of the disclosure, are given by way of illustration only, since various changes and modifications within the scope of the disclosure will become apparent to those skilled in the art from this detailed description.

Hence, it is to be understood that this disclosure is not limited to the particular component parts of the device described or steps of the methods described as such device and method may vary. It is also to be understood that the terminology used herein is for purpose of describing particular embodiments only, and is not intended to be limiting. It must be noted that, as used in the specification and the appended claim, the articles "a", "an", "the", and "said" are intended to mean that there are one or more of the elements unless the context clearly dictates otherwise. Thus, for example, reference to "a unit" or "the unit" may include several devices, and the like. Furthermore, the words "comprising", "including", "containing" and similar wordings does not exclude other elements or steps.

BRIEF DESCRIPTIONS OF THE DRAWINGS

The disclosure will by way of example be described in more detail with reference to the appended schematic drawings, which show presently preferred embodiments of the disclosure.

DETAILED DESCRIPTION

The present disclosure will now be described more fully hereinafter with reference to the accompanying drawings, in which currently preferred embodiments of the disclosure are shown. This disclosure may, however, be embodied in many different forms and should not be construed as limited to the embodiments set forth herein; rather, these embodiments are provided for thoroughness and completeness, and to fully convey the scope of the disclosure to the skilled person.

Figure 1:
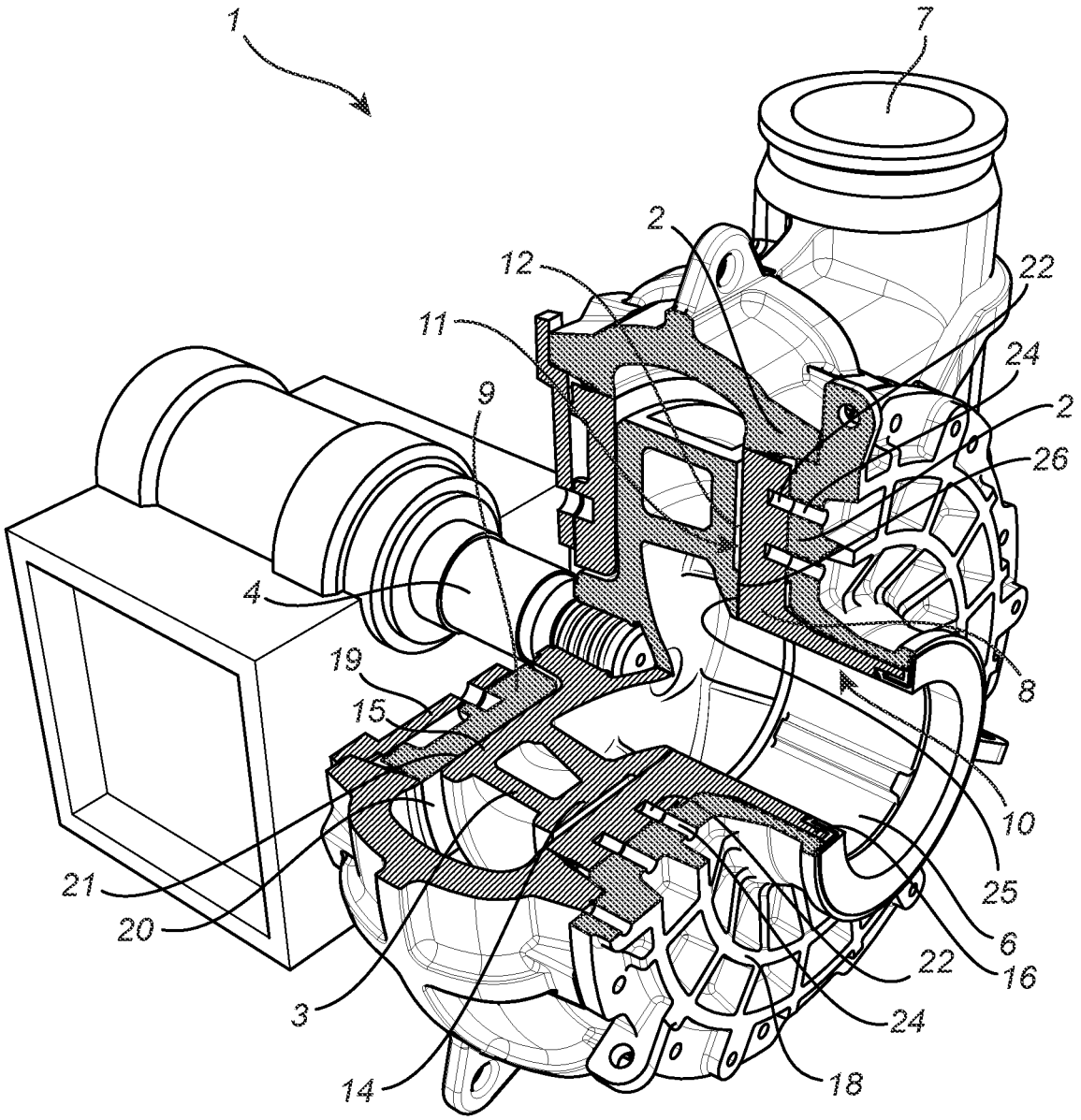
FIG. 1 shows a perspective, partly cut-out, view of a centrifugal pump with a suction liner according to an embodiment of the present disclosure.

FIG. 1 shows a centrifugal pump 1 for processing slurries in accordance with an embodiment of this disclosure. The centrifugal pump 1 comprises a casing 2, an impeller 3, and an impeller shaft 4 which holds the impeller 3 and which extends through and outside of the casing 2 where a motor (not shown) driving the impeller is arranged. The impeller 3 is thus housed within the casing 2. The impeller, which is a closed impeller, comprises a front end 14, also commonly called a front shroud, and a drive end 15, also referred to as a back end or back shroud 15. The casing 2 comprises an inlet 6 for the liquid to be pumped and an outlet 7 through which the pumped liquid is discharged, also referred to herein as the discharge 7. The inlet 6 is arranged in a side wall of the casing 2 facing the front end 14 of the impeller 3, and in line with the centre of the impeller 3, extending axially therefrom. The side wall of the casing 2 comprising the inlet 6 is hereonafter referred to as the suction side of the casing 2, and comprises a suction plate 18. The casing 2 further comprises a back side comprising a back plate 19, arranged opposite to the suction side. Here, the discharge 7 tangentially extends from a top part of the casing 2. The discharge 7 may, however, extend tangentially from any part of the casing 2.

The centrifugal pump 1 further comprises a suction liner 8 arranged along inner walls of the suction side of the casing 2.

Figure 2:
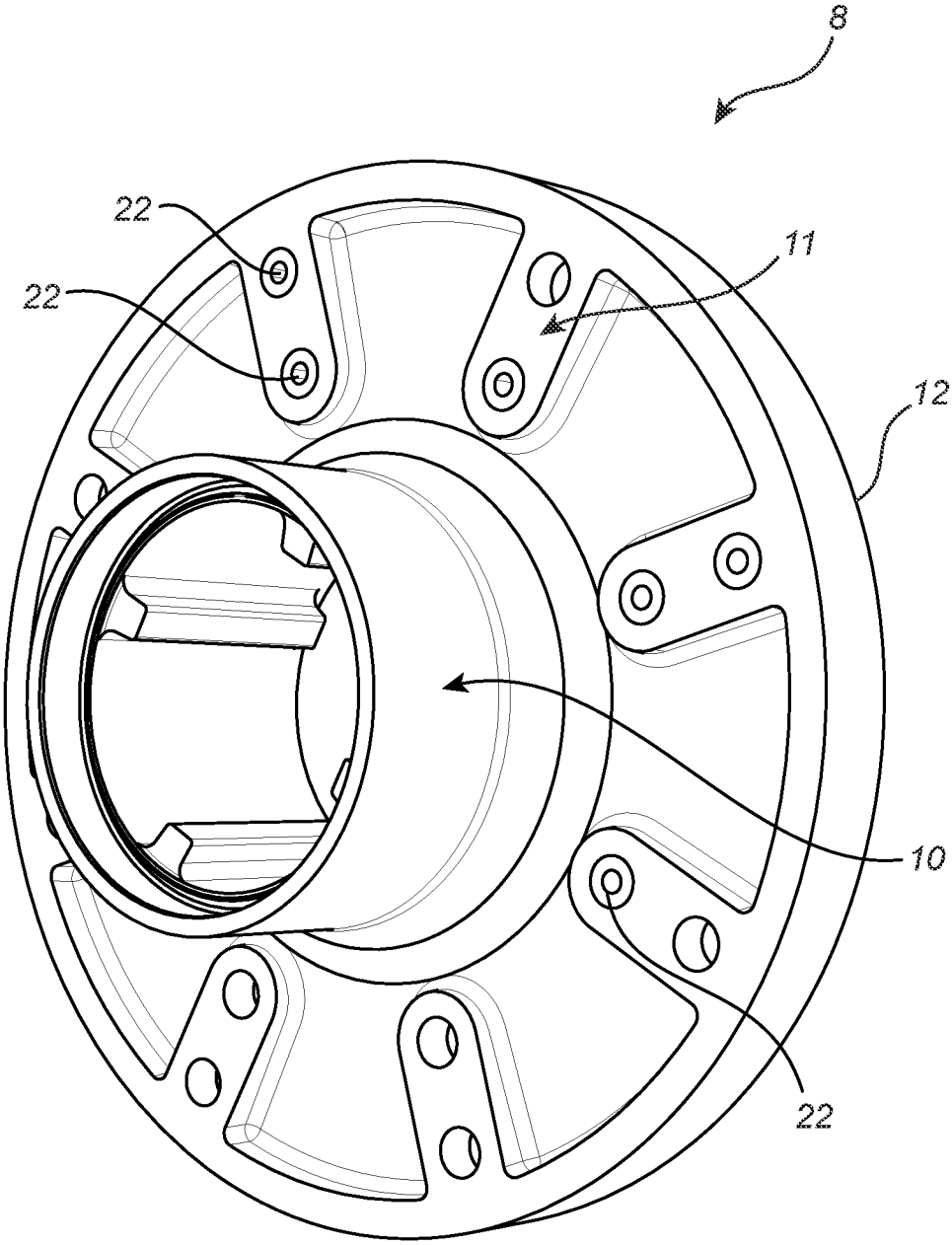
FIG. 2 shows a perspective view of a suction liner according to an embodiment of the present disclosure.

A closer view of the suction liner 8 according to an embodiment of the present disclosure is shown in FIG. 2. The suction liner 8 comprises a cylindrical portion 10 and a flange portion 11. The cylindrical portion 10 is cylindrically shaped and arrangeable in the casing 2 of the centrifugal pump 1 as shown in FIG. 1. More particularly, the cylindrical portion 10 of the suction liner 8 is, in the embodiment shown in FIG. 1, arranged along an inner wall 16 of the casing 2, here the inner wall of the inlet 6. The flange portion 11 protrudes outwards in a radial direction from the cylindrical portion 10 at an end thereof. The flange portion 11 comprises a front end surface 12, distal to the cylindrical portion 10 of the suction liner 8. In the shown embodiment, the suction liner 8 is made in one piece of a low friction polymer. However, providing a segmented suction liner is also conceivable within the concept of the present disclosure.

Figure 3:
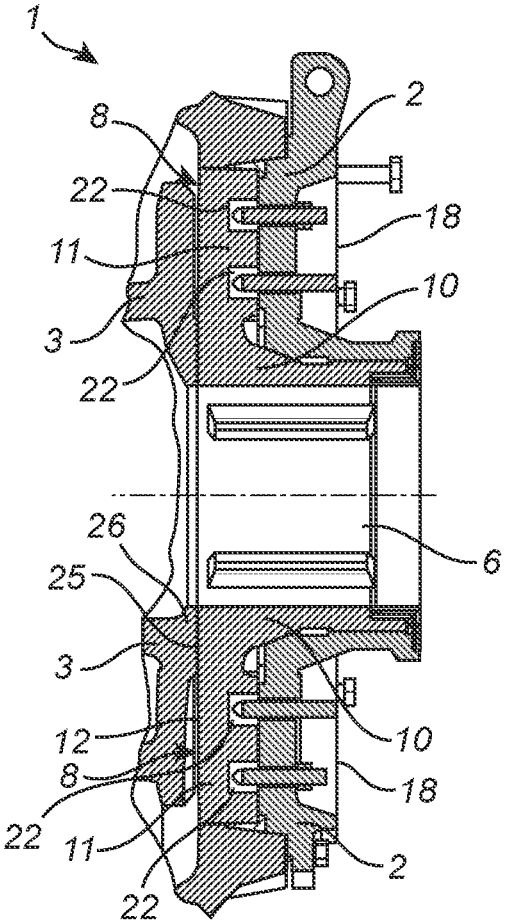
FIG. 3 shows a cross-sectional detail view of a suction liner arranged in a centrifugal pump according to an embodiment of the present disclosure.

Referring back to FIG. 1, the flange portion 11 of the suction liner 8 is arranged in the casing 2 of the centrifugal pump 1. More particularly, the flange portion 11 extends radially in an axial gap that is present between the front end 14 of the impeller 3 and the inner wall of the casing 2 at the suction side thereof. A portion of the front end surface 12 of the flange portion 11 is arranged to abut against a portion of the front end 14 of the impeller 3, as is best seen in FIG. 3, providing a detailed view of the centrifugal pump 1 shown in FIG. 1. Here, a radially inner portion 25 of the front end surface 12 of the flange portion 11 abuts against a central portion 26 of the front end 14 of the impeller 3.

The abutment of the suction liner 8 with the impeller 3 provides a seal of the axial gap between the impeller 3 and the casing 2. In the exemplifying embodiment of the suction liner 8 shown in FIG. 3, the radially inner portion 25 of the front end surface 12 of the flange portion 11 is flush against the central portion 26 of the front end 14 of the impeller 3, such that the aforementioned axial gap is sealed. Providing the flange portion 11 with a front end surface 12 comprising irregularities that match eventual irregularities in the front end 14 of the impeller 3 is, however, also possible within the concept of the present disclosure.

The suction liner 8 further comprises a plurality of fastening seats 22, each arranged to receive a fastener 23 for adjusting and fastening the suction liner 8 to the casing 2. The fastening seats 22 are preferably evenly distributed around the radial extension of the flange portion 11 of the suction liner 8, as shown in FIG. 2, such that the suction liner 8 is uniformly fastened to the casing 2. Thus, when arranged in the centrifugal pump 1, the portion of the front end surface 12 of the suction liner 8 which abuts against a portion of the front end 14 of the impeller exerts a uniformly distributed pressure on the impeller 3.

Similarly to the suction liner 8, the suction plate 18 of the casing 2 comprises fastener seats 24 which are aligned with the fastening seats 22 of the flange portion 11 of the suction liner 8. Each fastener seat 24 is arranged to receive the fastener 23 for adjusting and fastening the suction liner 8 to the casing 2. The fasteners 23 may be any kind of fastener suitable to fasten the suction liner 8 to the casing 2. In the embodiments shown in this disclosure, each fastener 23 comprises a bolt arranged in threaded engagement with a respective fastener seat 24 of the casing 2 and fastening seat 22 of the suction liner 8, and a nut with which adjustment and fastening is performed. The skilled person realizes that providing other types of fasteners suitable for the purpose of fastening and adjusting the suction liner 8 to the casing 2 are also possible within the concept of the present disclosure.

Furthermore, the exemplifying embodiment of the centrifugal pump 1 shown in FIG. 1 further comprises a drive liner 9. The drive liner 9 is arranged at an inner wall of the back side comprising the back plate 19 of the casing 2 and extends radially in an axial gap between the casing 2 and the impeller 3. The drive liner 9 comprises a front end surface 20 which abuts against a drive end surface 21 of the impeller 3 to seal a gap there between. The drive liner 9 is fastenable and adjustable in a corresponding manner as previously described with respect to the suction liner 8.

Figure 4:
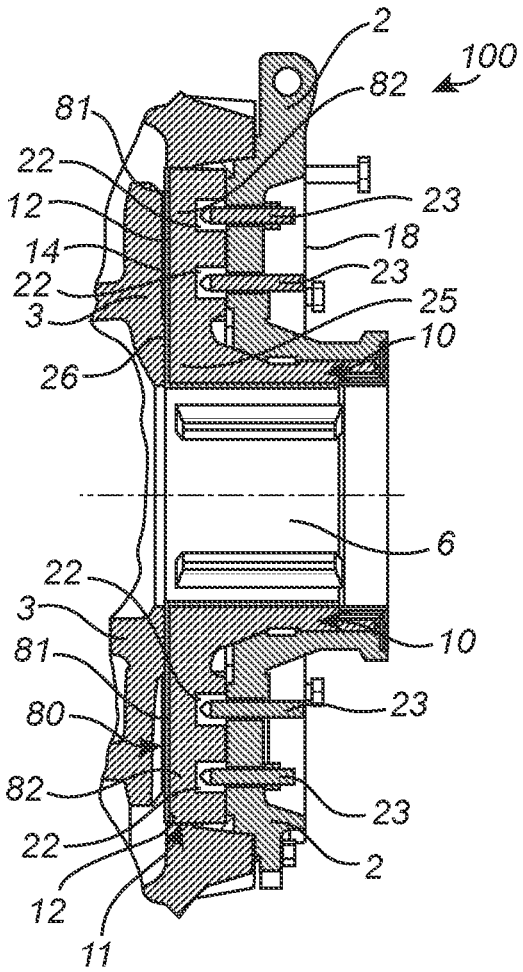
FIG. 4 shows a cross-sectional detail view of a suction liner arranged in a centrifugal pump according to another embodiment of the present disclosure.

FIG. 4 shows another exemplifying embodiment of a suction liner 80 arranged in a centrifugal pump 100. In this embodiment, the suction liner 80 comprises a coating 81 of a low friction polymer along the front end surface 12 of the flange portion 11 and along inner wall portions of the cylindrical portion 10 of the suction liner 80. As a substrate 82 for the coating of the low friction polymer, any material suitable for use in the mechanical conditions of centrifugal pumps processing slurries can be used. As an example only, the substrate 82 may be of a high chrome alloy. A suction liner comprising a coating only covering the front end surface 12 of the flange portion 11 of the suction liner 80, or a circular or circumferential portion thereof which is arranged to abut against a portion of the front end 14 of the impeller, is also possible within the concept of the present disclosure.

The person skilled in the art realizes that the present disclosure by no means is limited to the preferred embodiments described above. On the contrary, many modifications and variations are possible within the scope of the appended claims.

For example, instead of being substantially planar or straight, the front end surface 12 of the flange portion 11 of the suction liner 8 may comprise protrusions or recesses which complement the front surface 14 of the impeller 3, or at least a central portion 26 of the radially extending front surface 14 of the impeller. This also applies to the front end surface 20 of the drive liner 9.

Further, in an embodiment, the suction liner 8, 80 may be in the form of a disc wherein the cylindrical portion defines an inlet opening for the pumped liquid and the flange portion extends in a radial direction from the cylindrical portion.

Additionally, variations to the disclosed embodiments can be understood and effected by the skilled person in practicing the claimed disclosure, from a study of the drawings, the description, and the appended claims.

The invention claimed is:

1. A liner system for a centrifugal pump for processing slurries, the centrifugal pump comprising an impeller housed in a casing having an inlet, an outlet and an inner wall, the liner system comprising:

a suction liner; and a drive liner, wherein the suction liner comprises a cylindrical portion arranged in the casing of the centrifugal pump, and a flange portion which protrudes outwards in a radial direction from the cylindrical portion, wherein when the suction liner is arranged in the casing of the centrifugal pump, the cylindrical portion of the suction liner is arranged along the inner wall of the casing and at least a portion of a front end surface of the flange portion of the suction liner abuts against at least a portion of a front end of the impeller, such as to seal an axial gap between the suction liner and the impeller, wherein at least the front end surface of the flange portion is made of a low friction polymer, and wherein the drive liner comprises a front end surface and, when the drive liner is arranged in the casing of the centrifugal pump, the front end surface abuts against a back end surface of the impeller, wherein at least the front end surface of the drive liner comprises a low friction polymer.

2. The liner system according to claim 1, wherein the entire suction liner is made of the low friction polymer.

3. The liner system according to claim 1, wherein the suction liner comprises a metal substrate and a coating, wherein the coating is made of the low friction polymer.

4. The liner system according to claim 1, wherein the low friction polymer is a high performance thermoplastic.

5. The liner system according to claim 4, wherein the high performance thermoplastic is a semi-crystalline high performance thermoplastic.

6. The liner system according to claim 5, wherein the semi-crystalline high performance thermoplastic is polyether ether ketone (PEEK).

7. The liner system according to claim 1, wherein the at least the portion of the front end surface of the flange portion is arrangeable to be flush against the at least the portion of the front end of the impeller, such as to seal the axial gap between the flange portion and the impeller.

8. The liner system according to claim 1, wherein the at least the portion of the front end surface of the flange portion arrangeable to abut against the at least the portion of the front end of the impeller is curved.

9. The liner system according to claim 1, wherein the at least the portion of the front end surface of the flange portion, arrangeable to abut against the at least the portion of the front end of the impeller when the suction liner is mounted in the centrifugal pump, extends along a circumference of the front end surface.

10. A centrifugal pump for processing slurries, the centrifugal pump comprising:

an impeller, an impeller shaft, a casing which houses the impeller, which casing comprises an inlet, and an outlet and an inner wall, and a liner system comprising a suction liner and a drive liner, wherein the suction liner comprises a cylindrical portion arranged in the casing of the centrifugal pump, and a flange portion which protrudes outwards in a radial direction from the cylindrical portion, wherein when the suction liner is arranged in the casing of the centrifugal pump, the cylindrical portion of the suction liner is arranged along the inner wall of the casing and at least a portion of a front end surface of the flange portion of the suction liner abuts against at least a portion of a front end of the impeller, such as to seal an axial gap between the suction liner and the impeller, wherein at least the front end surface of the flange portion is made of a low friction polymer, and wherein the drive liner comprises a front end surface and, when the drive liner is arranged in the casing of the centrifugal pump, the front end surface of the drive liner abuts against a back end surface of the impeller, wherein at least the front end surface of the drive liner comprises a low friction polymer.

11. The centrifugal pump according to claim 10, wherein the cylindrical portion of the suction liner is arranged along the inner wall of the inlet of the casing.

* * * * *